US007438617B2

(12) United States Patent
Poldervaart et al.

(10) Patent No.: US 7,438,617 B2
(45) Date of Patent: Oct. 21, 2008

(54) TRANSFER SYSTEM AND METHOD FOR TRANSFERRING A CRYOGENIC FLUID FROM AN ONSHORE UNIT TO A SHIP BY MEANS OF A BUOY COMPRISING A REEL FOR A FLEXIBLE HOSE AND WHICH LEVEL IN THE WATER CAN BE CHANGED

(75) Inventors: Leendert Poldervaart, Monaco (MC); Hein Wille, Eze (FR); Hein Oomen, Nice (FR)

(73) Assignee: Single Buoy Moorings Inc. (MC)

( * ) Notice: Subject to any disclaimer, the term of this patent is extended or adjusted under 35 U.S.C. 154(b) by 119 days.

(21) Appl. No.: 10/583,555

(22) PCT Filed: Dec. 16, 2004

(86) PCT No.: PCT/NL2004/000875

§ 371 (c)(1),
(2), (4) Date: Jun. 19, 2006

(87) PCT Pub. No.: WO2005/059432

PCT Pub. Date: Jun. 30, 2005

(65) Prior Publication Data

US 2007/0155260 A1 Jul. 5, 2007

(30) Foreign Application Priority Data

Dec. 18, 2003 (EP) ..... 03079118

(51) Int. Cl.
*B63B 22/02* (2006.01)
*B63B 21/00* (2006.01)

(52) U.S. Cl. ..... 441/5; 114/230.1

(58) Field of Classification Search ..... 411/5
See application file for complete search history.

(56) References Cited

U.S. PATENT DOCUMENTS

| | | | | |
|---|---|---|---|---|
| 3,913,157 | A | 10/1975 | Kruisman et al. | |
| 4,315,408 | A * | 2/1982 | Karl | 62/50.7 |
| 5,431,589 | A | 7/1995 | Corona | |
| 6,012,292 | A | 1/2000 | Gulati et al. | |
| 6,244,053 | B1 | 6/2001 | Gulati et al. | |
| 6,997,643 | B2 * | 2/2006 | Wille et al. | 405/53 |
| 2003/0172991 | A1 | 9/2003 | De Baan | |

FOREIGN PATENT DOCUMENTS

| | | |
|---|---|---|
| DE | 38 33 488 | 4/1990 |
| FR | 1 569 861 | 6/1969 |
| FR | 2 837 190 | 9/2003 |

* cited by examiner

*Primary Examiner*—Jesús D Sotelo
(74) *Attorney, Agent, or Firm*—Young & Thompson

(57) ABSTRACT

A cryogenic transfer system includes:

Figure 1:
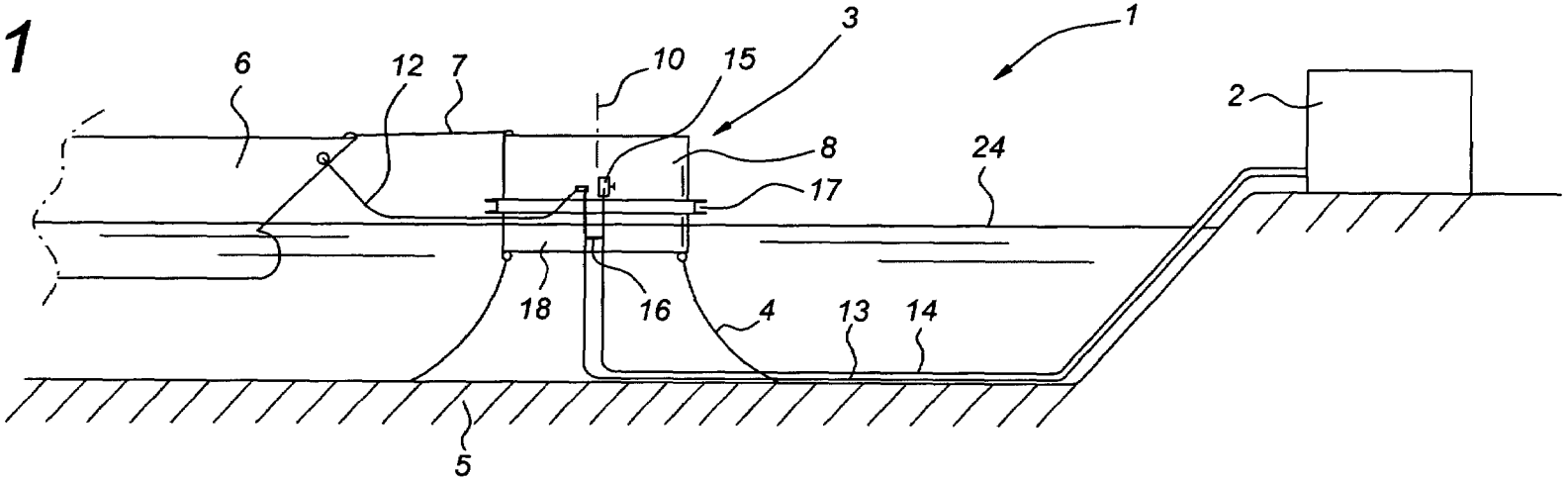

a cryogenic fluid storage and/or processing structure, an off shore loading and/or offloading structure having a base and a reel element rotatable relative to the base around an axis, a transfer duct extending from the fluid storage and/or processing structure to the loading and/or offloading structure, a flexible hose windable around the reel element, connectable with a first end to the duct, and with a second end to a floating structure.

The transfer duct includes a first and a second duct, each having an end part at or near the loading and/or offloading structure, the flexible hose being with the first end connectable to the end part of at least the first or the second duct.

The loading and/or offloading structure includes lifting elements.

12 Claims, 8 Drawing Sheets

TRANSFER SYSTEM AND METHOD FOR TRANSFERRING A CRYOGENIC FLUID FROM AN ONSHORE UNIT TO A SHIP BY MEANS OF A BUOY COMPRISING A REEL FOR A FLEXIBLE HOSE AND WHICH LEVEL IN THE WATER CAN BE CHANGED

The invention relates to a cryogenic transfer system comprising:

a cryogenic fluid storage and/or processing structure, an off shore loading and/or offloading structure comprising a base and a reel means rotatable relative to said base around a vertical axis, a transfer duct extending from the fluid storage and/or processing structure to the loading and/or offloading structure, a flexible hose windable around the reel means, connectable with a first end to the duct, and with a second end connectable to a floating structure.

The invention also relates to a method of transferring a cryogenic fluid.

Such a transfer system is known from U.S. Pat. No. 5,431,589. In this patent a submersible buoy is described comprising a rotatable turntable carrying a reel with a flexible hose, and a mooring hawser. The buoy is connected to a pipeline supported on the sea bed via an articulated pipe, the pipeline extending for instance to an onshore storage and processing facility for liquefied natural gas (LNG).

The known transfer structure is used in ice-infested waters, the loading and/or offloading structure being ballasted and submerged below the water surface when not in use. By storing the hose under water when not in use, the known hose is subject to fatigue. Furthermore, after placing the buoy into its operative position above water level, the hose on the reel will have to be cooled down first before cryogenic fluids can be transported through the hose. This will take considerable time and reduce the throughput of the known transfer structure for cryogenic fluids. Furthermore, the thermally induced expansion and contraction caused by the cooling and heating up, results in a reduced service life of the cryogenic fluid ducts.

It is an object of the present invention to provide a cryogenic transfer structure and method of transfer wherein a flexible hose can be stored on the loading and/or offloading structure and can be deployed into its operative position while being subject to reduced fatigue. It is a further object of the present invention to provide a transfer structure and transfer method for cryogenic fluids which can be maintained in a cooled state when not being operative in transferring cryogenic fluids, hence resulting in an increased throughput.

Hereto a transfer system according to the present invention is characterised in that the transfer duct comprises a first and a second duct, each duct having an end part at or near the loading and/or offloading structure, the floating hose being with a first end connectable to the end part of at least the first or the second duct, in a cooling configuration, the flexible hose being wound on the reel means, the reel means being situated above water level and rotatable around a vertical axis, an interconnecting duct section extending between the end parts of the first and second ducts, in a transfer configuration the flexible hose being at least partly unwound from the reel means and being with a second end connectable to a floating structure, the loading and/or offloading structure comprising lifting means for lowering the flexible hose towards water level for placing the hose in the transfer configuration and for raising the hose away from water level for placing the flexible hose in the cooling configuration.

By storing the flexible hose on the reel above water level, the hose is not subject to fatigue due to movements induced by the water and the hose can be inspected and be maintained in a dry environment. The horizontal storage configuration of the flexible hose allows for easy winding and unwinding of the flexible hose onto and from the reel.

The lifting means may comprise rollers along the circumference of the buoy, or other hose support devices. In a preferred embodiment, the reel is lowerable towards water level and raisable away from water level. During storage, the reel is raised away from water level to a dry position (for instance by deballasting in case the loading/offloading structure comprises a buoy). During winding and unwinding, the reel is close to water level (just above or below) such that the flexible hose, which preferably comprises a floating hose, is easily stored on the reel means and deployed and attached to a tanker. In case the loading/offloading structure comprises a buoy, the reel may be lowered by ballasting of the buoy with water. The length of the flexible hose may have a length of hundred of meters or more. For example, for midships LNG offloading of an LNG carrier a hose length of at least 200 meters is needed.

When the flexible hose is in its wound position on the reel and no fluids are transferred from or to the cryogenic processing and/or storage structure, the two duct sections are interconnected and cryogenic fluid is circulated from the processing and/or storage structure, via a first or main duct, to the interconnecting duct section and back through the second, or return duct, to the processing and/or storage structure. The processing and/or storage structure may be on offshore structure, but preferably is comprised of an on shore import/export facility.

The offshore loading and/or offloading structure may comprise a terminal, which in one embodiment is provided with a mooring means, such as a turntable, and attachment for mooring of a tanker via a hawser attached to the turntable.

The two ducts extending from the processing and/or storage structure to the loading and/or offloading structure, which may be a single point mooring loading/offloading terminal, may have a length of several kilometers and are preferably comprised of hard piping, having a diameter of at least 16 inches, preferably 24 inches. The ducts can be separate ducts or can be one duct placed within the other one (pipe in pipe configuration). The interconnecting duct extending between the two ducts at or near the offshore loading and/or offloading structure may be comprised of an interconnecting flexible or rigid line, but preferably is comprised of the wound up flexible hose, such that this hose remains cooled at cryogenic temperatures at all times when idle.

In one embodiment the loading and/or offloading structure comprises a ballastable buoy connected to the sea bed via anchor lines, such as a CALM buoy. Upon winding and unwinding of the hose, the buoy is ballasted such that the reel is located close to water level. In the wound position, the buoy is deballasted such that the reel is situated at a sufficient distance above water level. In another embodiment, the loading and/or offloading structure comprises a tower, resting on the sea bed, the reel being raised or lowered along the tower towards and away from sea level.

A CALM buoy having a reel rotatable around a vertical axis for storing of a flexible hydrocarbon transfer hose is known from U.S. Pat. No. 3,472,536 which is incorporated herein by reference. A method of transferring LNG to a storage tank via two transfer ducts and recirculating LNG through a closed loop consisting of the two LNG transfer ducts during idle times is known from U.S. Pat. No. 6,244,053 which is incorporated herein by reference.

The term "cryogenic temperatures" as is used herein is intended to comprise temperatures below minus 80° C.

Figure 2A:
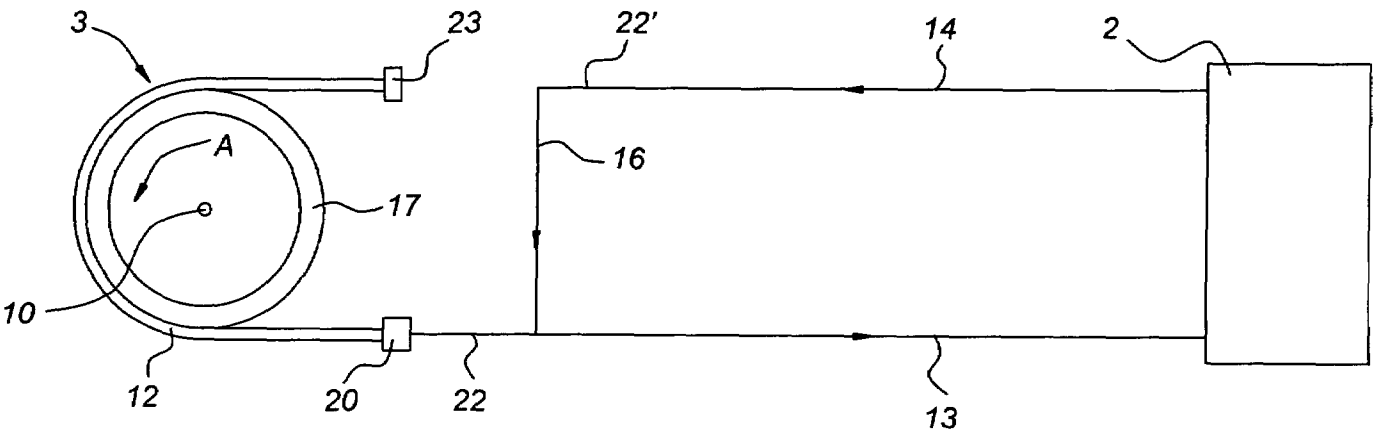
Figure 2B:
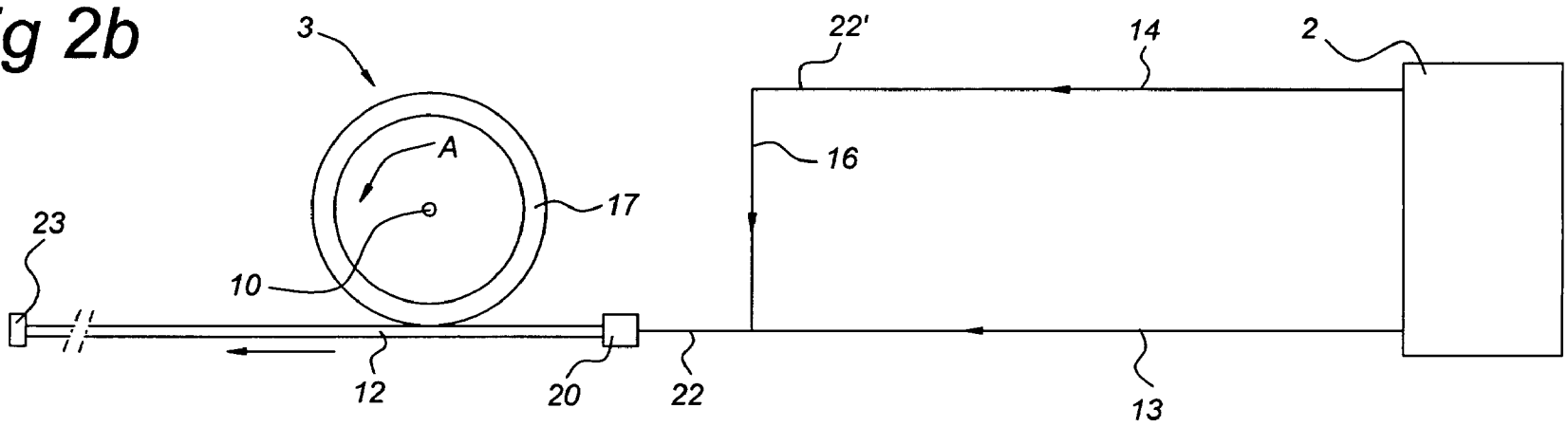
Figure 3A:
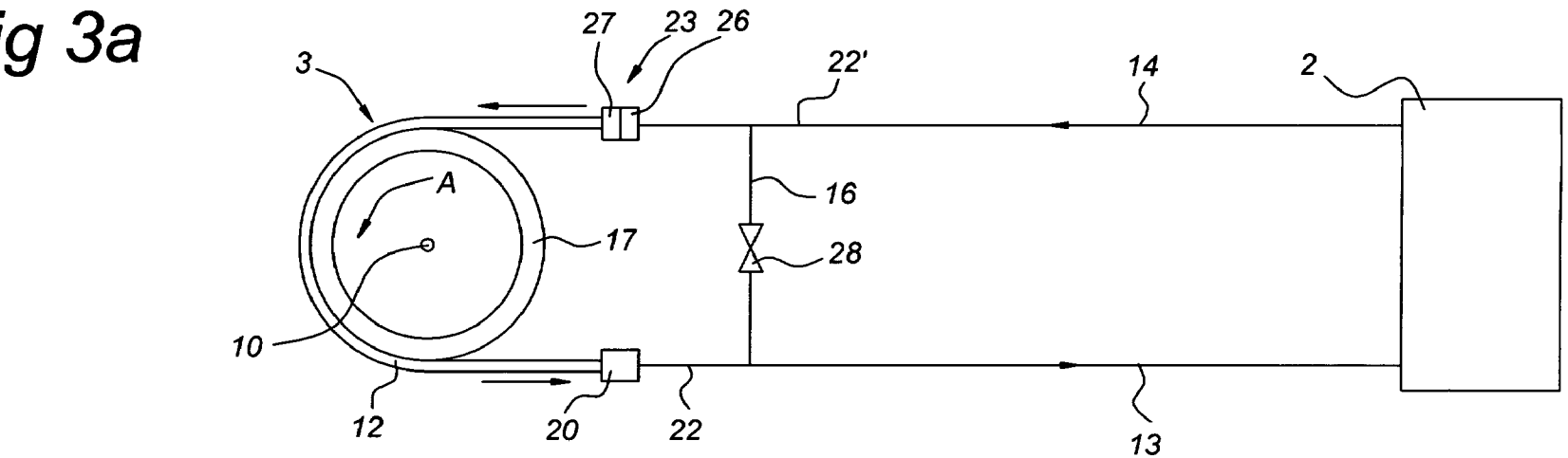
Figure 3B:
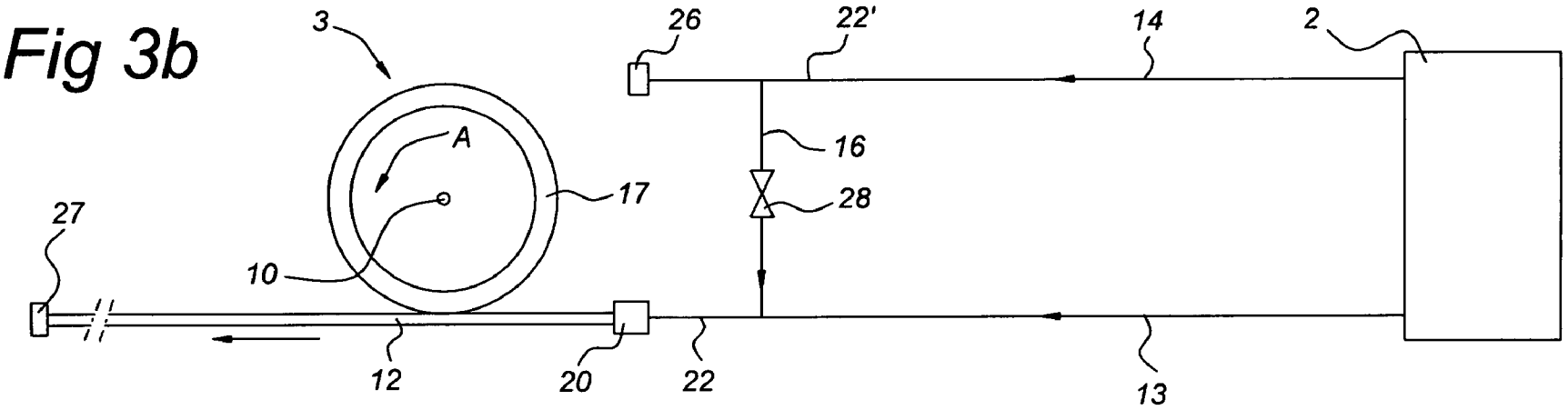
Figure 4:
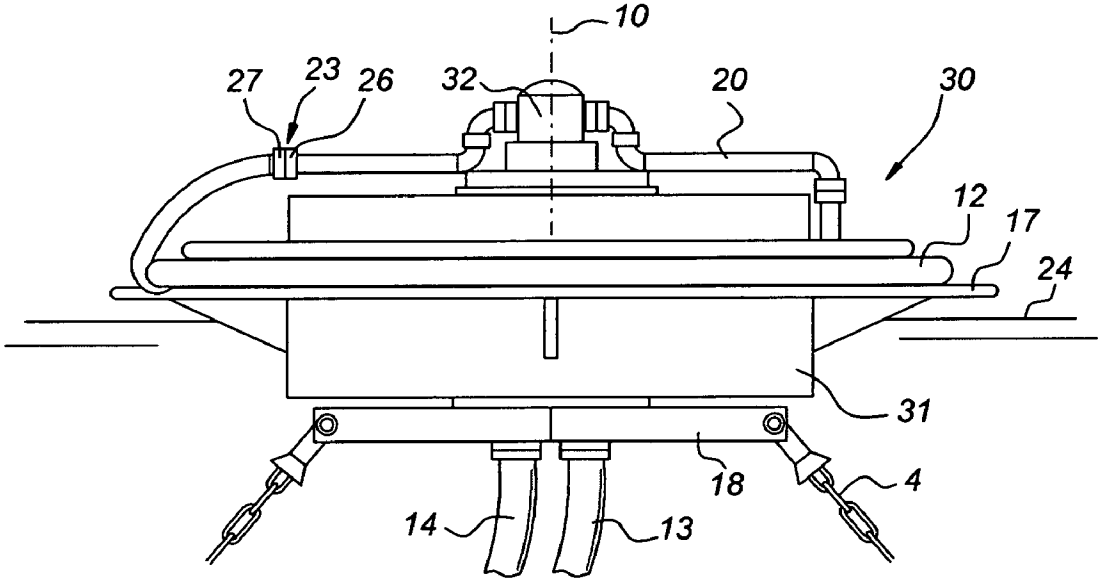
Figure 5:
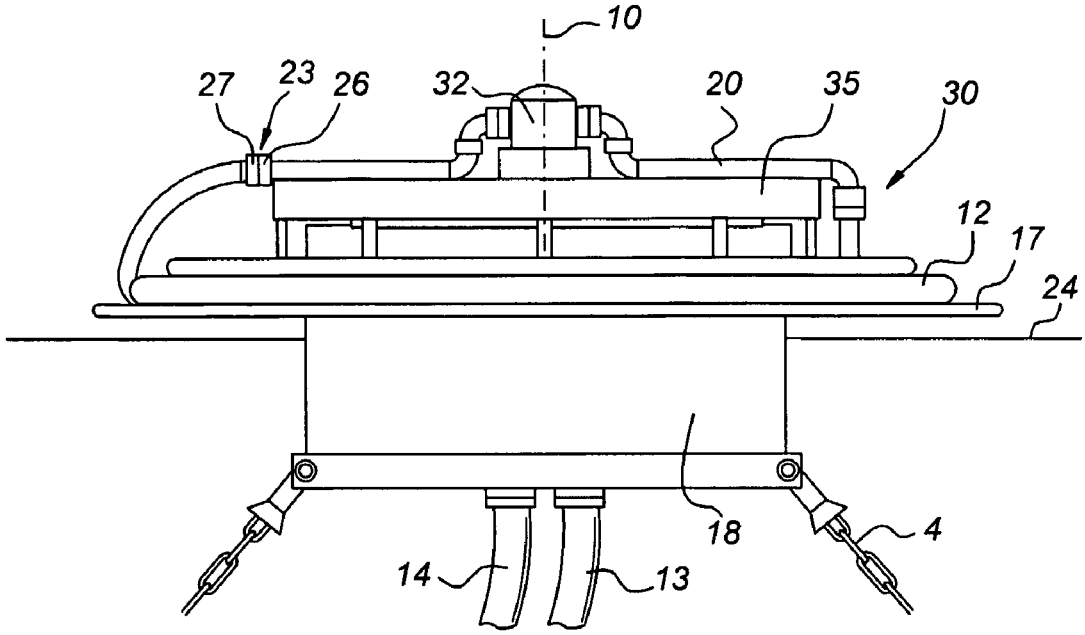
Figure 6:
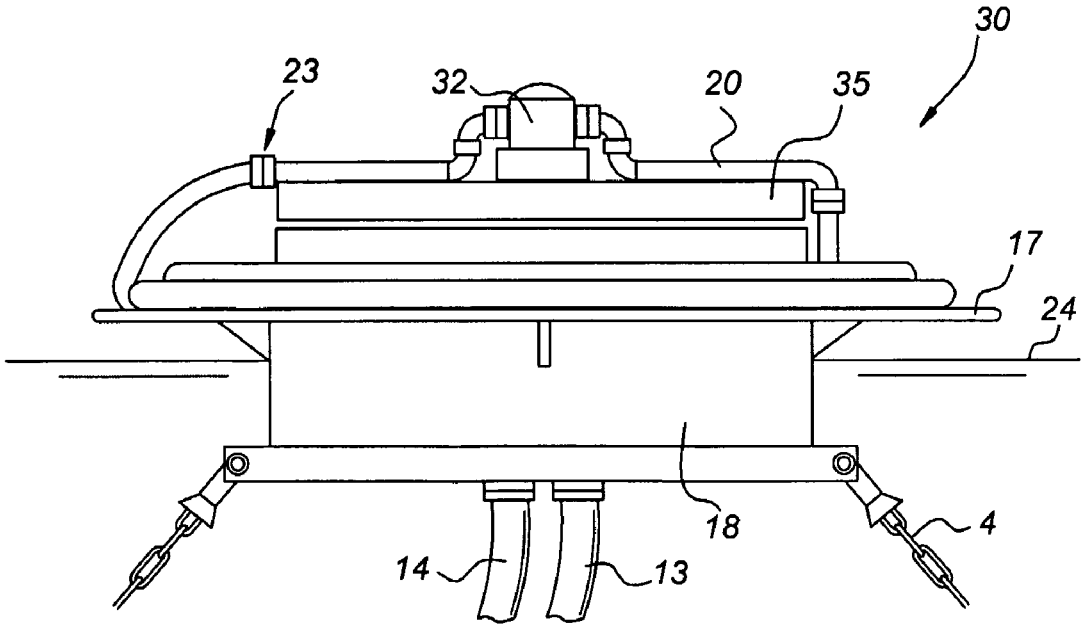
Figure 7:
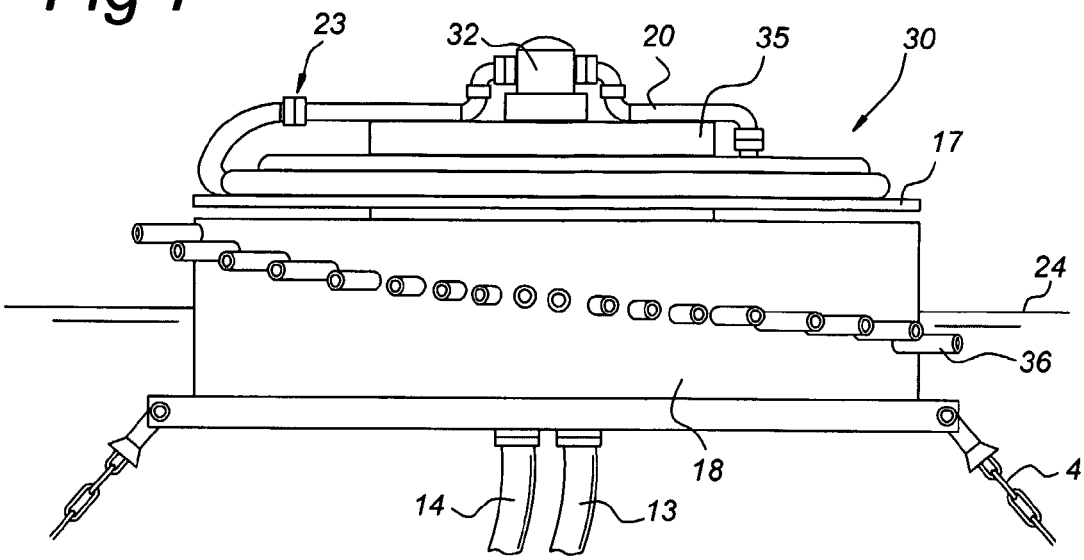
Figure 8:
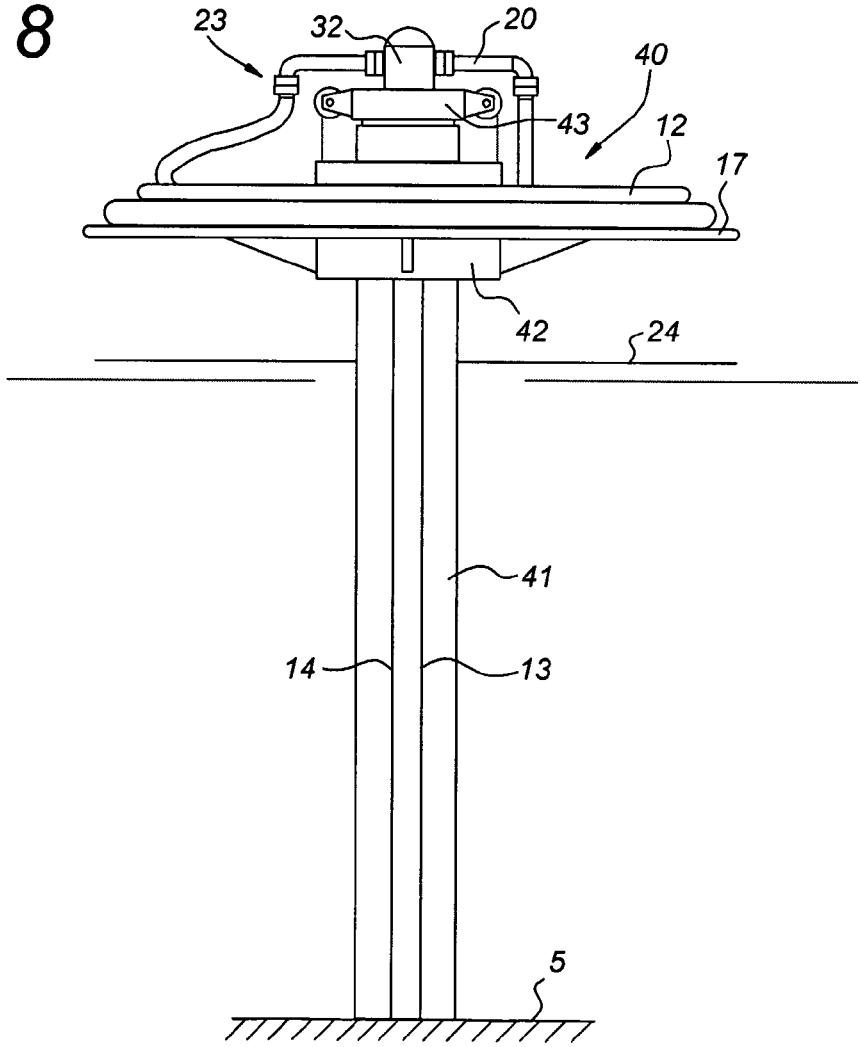
Figure 9:
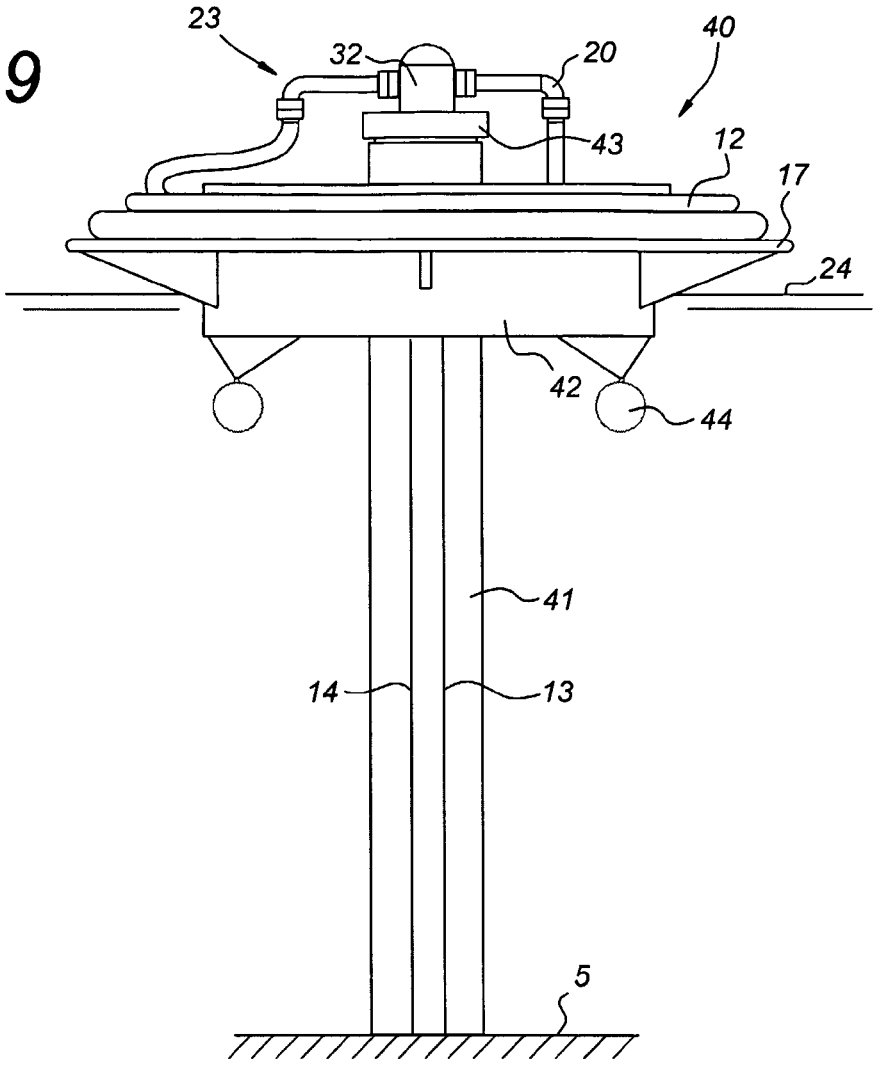
Figure 10:
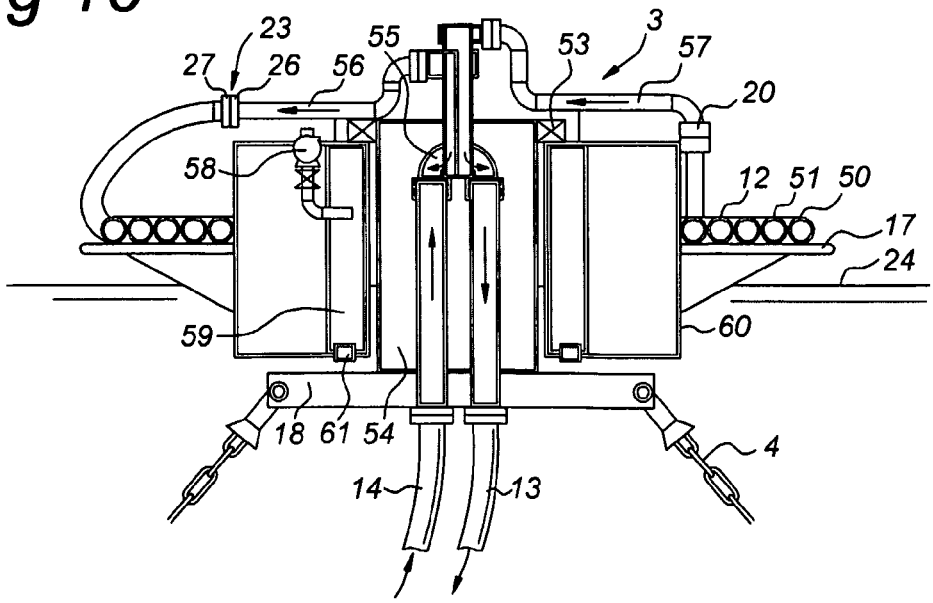

Some embodiments of a cryogenic transfer system and method will be described in detail with reference to the accompanying, non-limiting drawings. In the drawings:

FIG. 1 shows a schematic view of a cryogenic transfer system according to the present invention, FIGS. 2*a* and 2*b* show a schematic top view of a first embodiment of a cryogenic transfer system according to the present invention in the cooling and in the transfer configuration, respectively, FIGS. 3*a* and 3*b* show a schematic top view of a second embodiment of a cryogenic transfer system according to the present invention in the cooling and in the transfer configuration, respectively, FIG. 4 shows a preferred embodiment of a floating terminal with the reel means fixed to a rotatable buoy body, FIG. 5 shows an embodiment of a floating terminal with the reel means connected to a turntable, FIG. 6 shows an embodiment of a floating terminal with the reel means fixed to a non-rotatable buoy body, FIG. 7 shows an embodiment of a floating terminal with hose supporting rollers along its circumference, FIGS. 8 and 9 show embodiments of a loading/offloading structure comprising a tower supported on the sea bed, FIG. 10 shows a cross-sectional view of the loading/offloading buoy according to FIG. 4, and FIGS. 11, 12 and 13 show the buoy of FIG. 10 in its cooling position wherein the hose is stored above water level, in a submerged position in which the reel means are lowered below water level, and in its transfer position in which the flexible hose is unwound from the reel, respectively.

FIG. 1 shows a cryogenic transfer system 1, comprising an on shore storage and/or processing station 2, and an offshore terminal, in this case formed by a single point mooring buoy 3. The buoy 3 is anchored to the sea bed 5 via catenary anchor legs 4. A tanker 6 is moored to the buoy 3 via a hawser 7, attached to a turntable 8 of the buoy. The turntable 8 is rotatable around a vertical axis 10 (with "vertical" as is used herein is meant a direction which includes an angle of at least 45 degrees with a horizontal direction). The tanker 6 is in fluid connection with the on shore station 2 via a flexible, floating hose 12, which is attached to a first duct 13, extending along the sea bed to the on shore structure 2. A second duct 14 extends parallel to duct 13, and is closed at its end part by a closure device 15. A branching duct section 16 interconnects the ducts 13,14.

During or offloading of cryogenic fluids from the tanker 6, the cryogenic fluid is supplied via the flexible floating hose 12 to the duct 13 and via the branching duct 16, to the duct 14 for transport to the on shore station 2. When no cryogenic fluid is transported, the hose 12 is decoupled from the tanker 6, and is wound on a reel means 17 of the buoy 3, for instance by rotation of turntable 8 around the vertical axis 10 relative to the fixed base 18 of the buoy 3.

After the hose 12 has been wound around the buoy 3, the free end of the flexible hose 12, which is detached from the tanker 6 may remain disconnected as shown in FIG. 2*a* or may be connected to the end part of the duct 14, the closure device 15 being opened, as shown in FIG. 3*a*. Cryogenic fluid is then circulated under pressure (e.g. 10 bar) from the on shore station 2, via return duct 14, optionally through the hose 12, and back via duct 13 to the on shore station 2.

The on shore station 2 may comprise an LNG, LPG or nitrogen liquefaction plant, a processing plant (for water separation and purification), a power station, a storage facility or any other cryogenic structure. The cryogenic structure 2 may be placed on shore as is shown in the example of FIG. 1, but may also be situated at an off shore location, resting on the sea bed on a column or tower, or floating, e.g. supported on a barge.

The main and return transfer ducts 13,14 may be comprised of flexible hoses but are preferably comprised of rigid ducts, provided with insulation for preventing heat transfer into the ducts. The ducts 13,14 may have a parallel configuration, but in order to improve their insulating properties a concentric configuration is preferred.

FIG. 2*a* shows a top view of a cryogenic transfer structure of similar type as shown in FIG. 1 in which the same reference numerals are used to indicate similar parts. In FIG. 2*a* the flexible hose 12 is in its cooling, or idle configuration, and is wound several times around the reel means 17. A first end 20 of the flexible hose 12 is connected to the end part 22 of the duct 13. A second end 23 of the hose 12 is provided with a fluid coupling and can be attached to the tanker 6. In the idle or cooling stage shown in FIG. 2*a*, cryogenic fluid, such as liquefied natural gas or liquefied nitrogen, is circulated from the storage and/or processing structure 2, via duct 14, through branching duct section 16 and back through the return duct 13, to maintain the ducts 13 and 14 at cryogenic temperatures such as minus 160° C. at a pressure of 10 bar, at a relative low flow rate but such that any major gasification of the cryogenic fluid will not occur. The ducts 13 and 14 may have a length of between 50 m and several kilometers, and maintaining these ducts at cryogenic temperatures prevents long cooling times (e.g. 20 hours) prior to loading/offloading.

In FIG. 2*b* it is indicated that the flexible hose 12 is unwound from the reel means 17 by rotating the reel means around the vertical axis 10 in the direction of arrow A. Prior to unwinding, the hose 12 is lowered towards water level 24, for instance by ballasting the buoy 3. The second end 23 is coupled to piping on the tanker 6. Cryogenic fluid is transferred to the hose 12 via the ducts 13, 14, or vice versa.

In FIG. 3*a*, in the cooling configuration, the hose 12 is wound on the reel 17. The first end part 20 of the hose 12 is connected to the end part 22 of the return duct 13, the second end part 23 of the hose 12 being connected to the end part 22' of the main duct 14 via a releasable coupling 26,27. A valve 28 is provided in the branching duct 16, which is closed in the cooling configuration shown in FIG. 3*a*, wherein cryogenic fluid is supplied through the main duct 14, via flexible hose 12 wound on reel 17 and back via return duct 13 to the processing/storage structure 2. The hose 12 is placed in the transfer configuration by releasing the couplings 26,27. The part 26 of the coupling forms a closing end part of the duct 14, which is sealed in a fluid tight manner. Valve 28 in the branching duct 16 is opened, and coupling part 27 is attached to tanker 6. Cryogenic fluid is supplied from the structure 2 via the ducts 13, 14 to the hose 12 into the tanker 6, or vice versa.

In an alternative embodiment it is possible to omit the branching duct 16 shown in FIGS. 3*a* and 3*b*, in which case only duct 13 is available for transfer of fluid between the structure 2 and the vessel 6. When the branching duct 16 is omitted and only duct 13 is available for transfer of LNG, it is also possible to connect the coupling 26 of duct 14 with a separate hose directly to piping on the tanker 6 for transfer of boil-off gas to station 2. Depending on the LNG loading and/or offloading capacities needed, it is possible to use multiple interconnected transfer ducts 13, 14 and multiple flexible hoses 12 for the cryogenic transfer system, resulting in one or more closed loops in a cooling configuration.

In FIG. 4 a ballastable buoy 30 is shown in the cooling configuration, in which the hose 12 is wound on the reel means 17 above water level 24. The buoy 30 is ballastable. A chain table 18 is connected to the sea bed via anchor chains 4, whereas an annular buoy body 31 can rotate around the vertical axis 10 relative to the chain table 18, driven by motor drive 32.

In the embodiment of FIG. 5, a ballastable buoy 30 is shown, the hose 12 being wound around the reel means 17 which is connected to a rotatable turntable 35. The turntable is rotated by the motor drive 32 with respect to the fixed buoy body 18.

In the embodiment of FIG. 6, the reel means 17 is fixedly attached to the buoy body 18. The first and second ends 20, 23 of the hose 12 are connected to turntable 35 which is driven in rotation by motor drive 32.

In the embodiment of FIG. 7 positioning of the hose 12 above water level 24 is not achieved by deballasting of the buoy 30, but by rotating the reel means 17 attached to turntable 35. The hose is guided over a plurality of rollers 36 extending transversely along the buoy body, in an upward path extending from below water level 24 upwards to the reel means 17. Upon rotation of the turntable 35, the floating hose is pulled in around the reel 17 over the rollers 36, which can freely rotate around their longitudinal axes.

In the embodiment of FIG. 8, a tower 40 is shown in which the ducts 13,14 extend internally inside the column 41, resting on the sea bed 5. The reel means 17 and the hose 12 are supported on a support frame 42 extending around the column, which frame can be raised and lowered along the column 41 via lifting device 43.

In the embodiment of FIG. 9, the support frame 42 is provided with ballast tanks 44 which can be filled with water or emptied by pressurised air to lower or raise the support frame 42.

Figure 11:
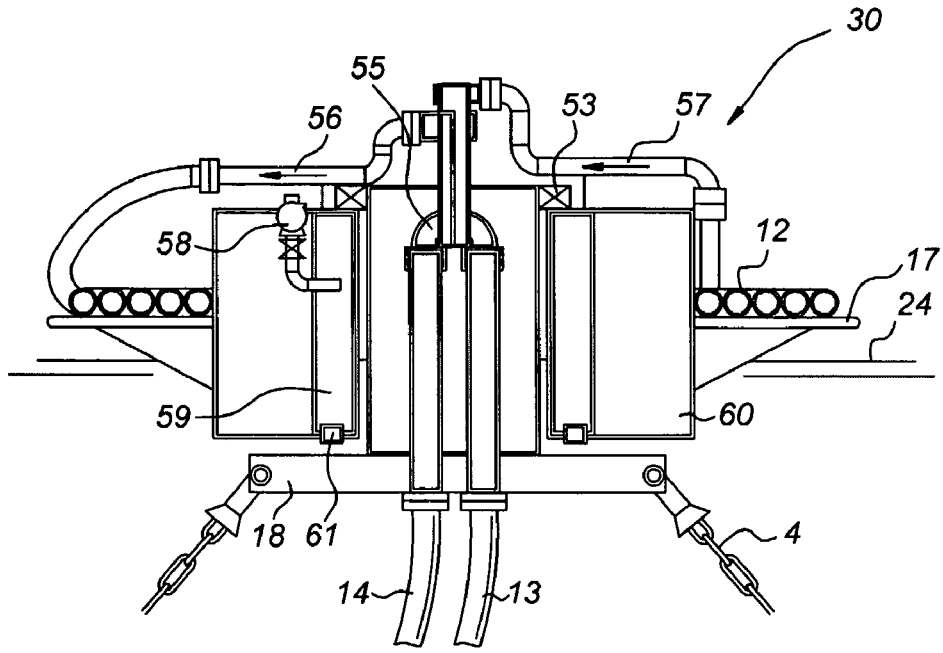
Figure 12:
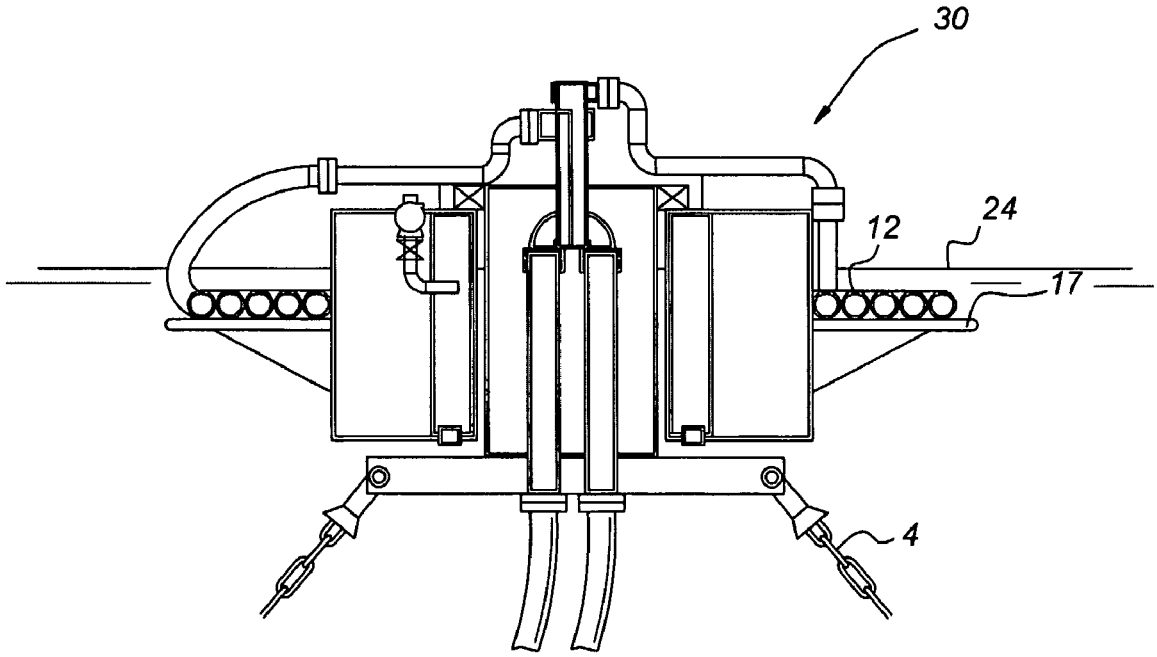
Figure 13:
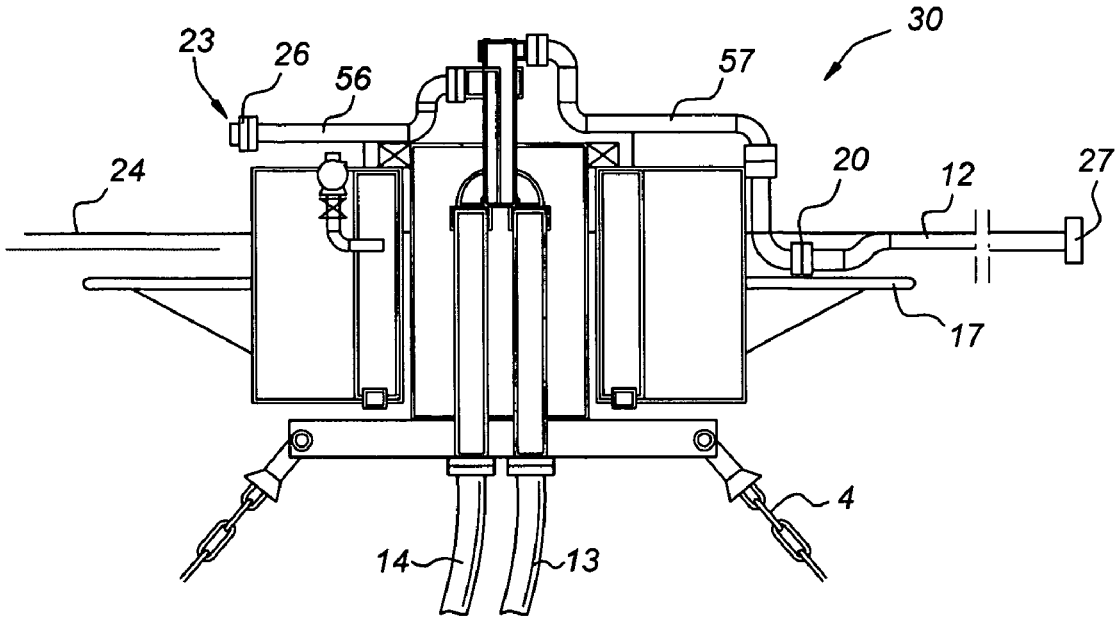

FIG. 10 shows a cross-sectional view of ballastable buoy 30 according to the invention, with the chain table 18, on which a central core 54 is supported. Rotatable around the core 54 an annular body 60 is supported by axial-radial bearings 53 and axial bearings 61. The ducts 13, 14 extend through the central core 54 to a manifold 55, from which ducts connect to radial conduits 56, 57. The Flexible hose 12 is supported in a number of concentric loops in a horizontal plane on the reel means 17. Via a pump and valve assembly 58, water can be introduced into ballast compartments 59 of the buoy 30. FIG. 11 shows the buoy 30 of FIG. 10 in the cooling position, in which no water is present in the ballast compartments 59, and the hose 12 is supported in a dry position above water level, wound in a horizontal plane around the annular body 60. Cryogenic fluid is circulated through the ducts 13, 14 and through the hose 12. Prior to unwinding the hose from the reel means 17, the ballast tanks 59 are filled by operating pump and valve assembly 58 and by introducing water into the tanks 59 such that the hose 12 is submerged below water level 24, as is shown in FIG. 12. FIG. 13 finally shows the hose 12 being placed into its transfer configuration, by detaching the couplings 26,27, the radial conduit 56 being closed by closure device 26, and unwinding the hose 12, the coupling 27 being attached to a tanker. Cryogenic fluid is supplied via duct 13, radial conduit 57 and the unwound floating flexible hose 12.

The invention claimed is:

1. Cryogenic transfer system (1) comprising:

a cryogenic fluid storage (2), an off shore transfer structure (3,30, 40) comprising a base (18,41) and a reel means (17) rotatable relative to said base around an axis (10), a transfer duct (13,14) extending from the fluid storage (2) to the transfer structure (3,30,40), a flexible hose (12) windable around the reel means (17), connectable with a first end (20) to the duct (13,14), and with a second end (23) connectable to a floating structure (6), wherein the transfer duct comprises a first and a second duct (13,14), each duct having an end part (22,22') near the transfer structure (3,30,40), the flexible hose (12) being with the first end (20) connectable to the end part (22) of at least one of the first and the second duct, wherein in a cooling configuration, the flexible hose (12) is wound on the reel means (17), the reel means being situated above water level (24) and rotatable around a vertical axis (10), an interconnecting duct section (12, 16) extending between the end parts (22,22') of the first and second ducts (13,14), and wherein in a transfer configuration, the flexible hose (12) is at least partly unwound from the reel means (17) and is, with a second end (23), connectable to the floating structure (6), the transfer structure (3,30,40) comprising lifting means (36,43,58,59) for lowering the flexible hose (12) towards water level (24) in the transfer configuration and for raising the hose (12) away from water level for placing the flexible hose in the cooling configuration.

2. Cryogenic transfer system (1) according to claim 1, the lifting means comprising a buoy that is movable with respect to water level.

3. Cryogenic transfer system (1) according to claim 1, the interconnecting duct section comprising the flexible hose (12).

4. Cryogenic transfer system (1) according to claim 3, the end part (22') of one of the ducts (14) being releasably coupled to the flexible hose (12).

5. Cryogenic transfer system (1) according to claim 4, the end part (22') being provided with an end closing device (26).

6. Cryogenic transfer system (1) according to claim 1, the end parts (22,22') of the ducts (13,14) being interconnected via a branching duct section (16).

7. Cryogenic transfer system (1) according to claim 1, the transfer structure (3,30) comprising a ballastable buoy, the base (18) being moored to the sea bed (5).

8. Cryogenic transfer system according to claim 1, the base comprising a column (41) resting on the sea bed (5).

9. Cryogenic transfer system (1) according to claim 1, the transfer structure comprising a drive means for rotation of the reel around its vertical axis.

10. Cryogenic transfer system (1) according to claim 1, the reel means (17) having a diameter of at least 10 m.

11. Cryogenic transfer system (1) according to claim 1, the transfer duct (13,14) comprising a rigid pipe.

12. Method of transferring a cryogenic fluid from a storage to an off shore transfer structure, the transfer structure comprising a base and a reel rotatable relative to said base around a vertical axis, a transfer duct extending from the fluid storage to the transfer structure, a flexible hose windable around the reel and having a first end connectable to the duct and a second end connectable to a tanker vessel, the method comprising the steps of:

in a cooling stage, placing the reel above water level, winding the hose around the reel and providing cooling fluid from the storage through the transfer duct towards the transfer structure, and in a transfer stage:

lowering the reel towards water level, unwinding the flexible hose at least partly from the reel, connecting the second end of the flexible hose to a floating structure, and conveying cryogenic fluid between the transfer structure and the floating structure.

* * * * *